US006400078B1

(12) United States Patent
Van Bommel et al.

(10) Patent No.: US 6,400,078 B1
(45) Date of Patent: Jun. 4, 2002

(54) DISPLAY PANEL

(75) Inventors: Cornelus H. M. Van Bommel; Franciscus M. H. Van Laarhoven; Ronald Van Rijswijk, all of Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/351,379

(22) Filed: Jul. 13, 1999

(30) Foreign Application Priority Data

Jul. 15, 1998 (EP) ..... 98202371.5

(51) Int. Cl.[7] ..... H01J 9/38

(52) U.S. Cl. ..... 313/582; 313/581; 313/583; 313/584

(58) Field of Search ..... 313/582, 643, 313/581, 583, 584, 355, 352, 567, 326, 331

(56) References Cited

U.S. PATENT DOCUMENTS 3,821,584 A * 6/1974 Scovronek ..... 313/174
3,837,724 A * 9/1974 Haberland et al. ..... 313/220
3,998,525 A * 12/1976 Giglia ..... 350/160 R
5,977,706 A * 11/1999 Cho et al. ..... 313/553

FOREIGN PATENT DOCUMENTS

NL 7308590 2/1974 ..... H01J/61/64
WO WO 9826443 6/1998 ..... H01J/29/46

OTHER PUBLICATIONS

"High Resolution Displays and Projection systems" by J. S. Moore et al. In the Proceedings of The International Society for Optical Engineering of Feb. 11–12, 1992 in California.

* cited by examiner

*Primary Examiner*—Vip Patel
*Assistant Examiner*—Ken A Berck

(57) ABSTRACT

The present invention relates to an image display panel (1) having a substrate (21) having at least one channel (31, 32, 33, 34, 35) comprising an ionizable gas mixture (51). The walls of the channels are provided with electrodes (37, 39) for selectively ionizing the ionizable gas mixture during operation. The display panel is provided with an exhaust box (55) and an exhaust tube (57) which are formed in one piece. The exhaust box (55) and exhaust tube (57) are provided at the back of the substrate (21) and extend in a plane parallel to the plane of the display panel.

1 Claim, 3 Drawing Sheets

DISPLAY PANEL

BACKGROUND OF THE INVENTION

The invention relates to a display panel comprising a substrate having at least one compartment which contains an ionizable gas mixture, electrodes being present in the compartments for selectively ionizing the ionizable gas mixture during operation, said display panel being provided with an exhaust tube.

The invention also relates to a display device comprising such a display panel.

Display panels for displaying monochromatic images or color images comprise, inter alia, plasma-addressed liquid crystalline display panels, referred to as PALC displays, and plasma display panels (PDP). Such panels are used, for example, as displays for televisions and computer applications. In a plasma display panel, the plasma in the channels generates UV radiation which excites electroluminescent phosphors, and in a PALC display, the plasma is used to address a liquid crystalline material.

A display panel of the type described in the opening paragraph is known from, for example, the article "High Resolution Displays and Projection Systems" by J. S. Moore et al. in the Proceedings of The International Society for Optical Engineering of Feb. 11–12 1992, California. The display panel of the flat-panel type described in this article is a PALC display and has a display screen with a pattern of (identical) data storage or display elements, and a number of compartments. The compartments are filled with an ionizable gas mixture and are provided with electrodes for ionizing the ionizable gas mixture. In the known display panel, the compartments have the shape of parallel, elongate channels provided in a substrate referred to as channel plate. The channels function as selection means for the display panel, referred to as the plasma-addressed row electrodes. By applying a voltage difference across the electrodes in one of the channels of the channel plate, electrons are emitted from the cathode. The electrons ionize the ionizable gas mixture so that a plasma is formed (plasma discharge). When the voltage across the electrodes in one channel is switched off and the gas is de-ionized, a subsequent channel is switched on. At the display screen side of the display panel, the compartments are sealed by means of a relatively thin dielectric layer, referred to as microsheet, which is provided with a layer of an electro-optical material, and further electrodes which function as the data electrodes or column electrodes of the display panel. The further electrodes are provided on a second substrate. The display panel is constituted by the assembly of the channel plate with the electrodes and the ionizable gas mixture, the dielectric layer, the layer of the electro-optical material and the further electrodes.

A plasma display panel (PDP) has an apertured selection structure provided with row and column electrodes in a vacuum envelope between a rear wall provided with a plasma cathode and a front wall provided with a display screen having pattern of luminescing pixels. In operation, a gas discharge is maintained between the plasma cathode and a series of row electrodes which function as anode. A number of the electrons from the gas discharge arriving at the anode passes the apertures of the selection structure at the location of a crossing of a row and a column electrode. The current through the selection structure is determined by the voltage applied across the column electrode corresponding to the relevant row electrode. As soon as the electrons have passed through the selection structure, they are accelerated in order to give the electrons sufficient energy to excite the luminescent pixels.

In both types of display panels described, the channel plate of the display panel is first vacuum-exhausted and subsequently filled with gas. Exhausting and filling are effected by means of, for example an exhaust tube. This exhaust tube may be directly fritted at the location of an aperture on the substrate surface remote from the display side of the display panel. Alternatively, an exhaust box to which the exhaust tube is connected may be present on the substrate at the location of said aperture. The exhaust box described in said article is made of a ceramic material and the exhaust tube is made of glass. After exhausting and filling with gas, the glass tube is sealed.

To extend the lifetime of such display panels, decrease the ignition voltage of the plasma and obtain a faster extinction of the plasma, the ionizable gas mixture in PALC displays preferably consists of an ionizable basic gas, for example helium, and an additional gas. The additional gas may be, for example, hydrogen, deuterium or hydrogen deuterium. To maintain the partial pressure of the additional gas substantially constant, additional gas is to be continuously added to the gas mixture. To this end, use is made of a getter in which the additional gas is stored. The getter may be secured by means of, for example a spring construction in the exhaust tube or, if present, in the exhaust box, the exhaust tube and the exhaust box communicating with the channel plate via an aperture in the surface remote from the display side of the display panel.

The exhaust tube described in said article is substantially perpendicular to the plane of the substrate. Since the exhaust tube is made of glass, it is very vulnerable. To this end, the exhaust tube should generally be made of glass which is sufficiently thick, which detrimentally influences the weight of the display panel.

OBJECTS AND SUMMARY OF THE INVENTION

It is an object of the present invention to provide a display panel in which the above-mentioned drawback is obviated.

To this end, the display panel according to the invention is characterized in that the exhaust tube extends in a plane parallel to that of the display panel on a substrate surface located opposite the display screen surface.

In this way, the exhaust tube is much less vulnerable than in a position substantially perpendicular to the plane of the panel. Besides, such a construction requires relatively little space so that the build-in depth of the display panel remains limited. It is sufficient to use an exhaust tube of relatively thin glass, which is to the benefit of the weight of the display panel. Moreover, the display panel can be laid on its rear side without any problem.

The exhaust tube may be directly fritted on the channel plate, but alternatively, an exhaust box may be present between the channel plate and the exhaust tube. The exhaust box described in the above-mentioned article is made of a ceramic material. However, ceramic material is rather heavy and also permeable to the ionizable gas mixture. To guarantee some impermeability, the walls should be fairly thick, which makes the exhaust box even heavier.

A preferred embodiment of the display panel according to the invention, in which the display panel comprises an exhaust box, is characterized in that the exhaust box and the exhaust tube are made of the same material as the substrate of the display panel.

Since both the exhaust box and the exhaust tube are made of the same material, it is not a necessity but they can be made as one assembly. Since the material of the exhaust box is also the same material as that of the substrate, the tension in the connection between the exhaust box and the substrate of the display panel will be reduced to a minimum. Moreover, an exhaust box of glass has a much lighter weight than an impermeable exhaust box of ceramic material.

If there is an exhaust box, the getter material may be provided in the exhaust box instead of in the exhaust tube.

A further embodiment of the display panel according to the invention is characterized in that the exhaust box is constituted by a widening of the exhaust tube, while at least a part is longitudinally ground open at the location of the widening.

As a result, the width of the edge of the exhaust box with which the connection to the substrate of the display panel is realized is thicker than the wall of the exhaust box itself. In this way, a sufficiently rigid fritting seam can be made by means of a thin-walled and hence light-weight exhaust box.

Moreover, the more components of the display panel are made of the same material, the simpler it will be to determine the loss of ionizable gas occurring during operation of the panel, so that relatively simple measuring methods can be used for this purpose.

A further embodiment of the display panel according to the invention is characterized in that the longitudinal axis of the exhaust tube and the longitudinal axis of the exhaust box enclose an angle between 30° and 60°, preferably an angle of substantially 45°, the exhaust tube extending in a direction parallel to one side of the display panel.

This construction has the advantage that the glass exhaust tube is positioned just beyond the active part of the channel plate and will thus not be visible at the display side of the display panel.

These and other aspects of the invention will be apparent from and elucidated with reference to the embodiments described hereinafter.

DESCRIPTION OF THE PREFERRED EMBODIMENTS

Figure 1:
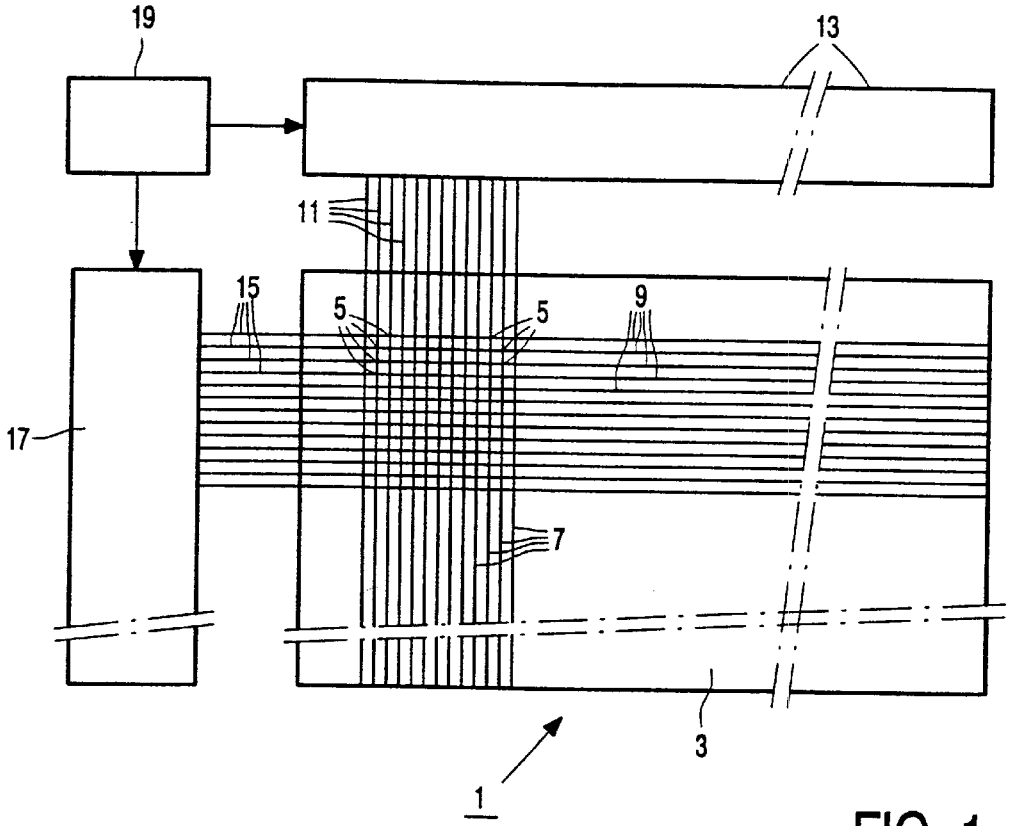
FIG. 1 is a block diagram of a display panel.

FIG. 1 is a block diagram of a conventional display panel 1 with a substrate 3 having a surface which is provided with a pattern of pixels which are mutually separated from each other in the vertical and horizontal directions. Each pixel 5 comprises overlapping portions of thin, narrow electrodes 7 of a group of electrodes which are arranged in vertical columns, and thin, narrow electrodes 9 of a further group of electrodes which are arranged in horizontal rows. The electrodes 7 of the group of electrodes are also referred to as column electrodes and the electrodes 9 of the further group of electrodes are also referred to as row electrodes. In a plasma-addressed liquid crystal display device (PALC), the rows are formed by long, narrow channels, also referred to as compartments.

The width of the electrodes 7, 9 defines the dimensions of the pixels 5 which typically are rectangular. Electrodes 7 receive drive signals from a drive circuit 13 via conductors 11, and electrodes 9 receive drive signals from a drive circuit 17 via conductors 15.

To realize an image or a datagraphic display on a relevant area of the surface of the substrate 3, the display panel makes use of a control circuit 19 which controls the drive circuits 13 and 15. Various types of electro-optical materials may be used in the display panel. Examples of electro-optical materials are (twisted) nematic or ferro-electric liquid crystalline materials.

Figure 2:
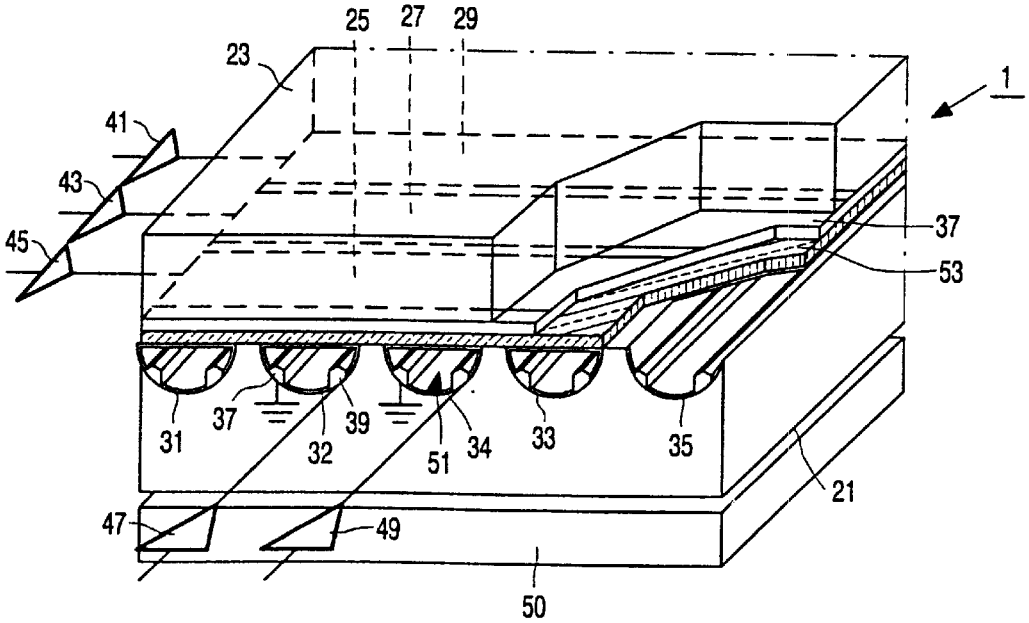
FIG. 2 is a diagrammatic perspective view of a part of a display device with a plasma-addressed display panel.

FIG. 2 is a diagrammatic perspective view of a display device comprising a display panel 1 and a background illumination system 50. The display panel 1 is implemented as a plasma-addressed liquid crystalline display panel with a first substrate 21 and a second substrate 23. FIG. 2 shows only three column electrodes 25, 27, 29. The row electrodes 31, 32, 33, 34, 35, which function as selection means, are constituted by a plurality of parallel, elongate channels (compartments) under a layer 37 of an electro-optical material. Each channel 31, 32, 33, 34, 35 is filled with an ionizable gas mixture 51 and is sealed by means of a thin dielectric layer ("microsheet") 53 consisting of, for example, glass. An inner surface of each compartment is provided with first and second elongate electrodes 37, 39 extending throughout the length of the channel. The second electrode 39 is referred to as anode and is fed with a pulsed voltage, referred to as "strobe pulse", with electrons emitted from the cathode 37 ionizing the gas mixture so that a plasma is formed. The panel is provided with electric connections to the column electrodes 25, 27, 29 and to the plasma electrodes 37, 39, the column electrodes 25, 27, 29 receiving (analog) drive signals from output amplifiers 41, 43, 45, and the anode electrodes 39 in the channels 32, 34 receiving drive signals from output amplifiers 47, 49. In an alternative embodiment, the cathode is fed with a negative (DC) pulse. The next channel is not switched on until after termination of the "strobe pulse" and de-ionization of the gas mixture. To reduce the cycle period, the next channel is usually ionized before the previous channel has been (completely) de-ionized.

The display panel 1 is illuminated substantially throughout its surface by the background illumination system 50. The illumination system 50 may comprise a meander-shaped lamp, but may alternatively comprise a plurality of separate lamps.

In PALC display panels, helium (He) is generally used as the main constituent of the ionizable gas mixture 51. In an alternative embodiment, nitrogen ($N_2$) is used as a basic gas. The ignition voltage of the plasma discharge may be reduced by adding relatively small quantities of a gas (of the order of 0.1 to 3%) to the helium (or nitrogen). A known additional gas added to the basic gas for forming mixtures referred to as Penning mixtures is hydrogen ($H_2$) or another gas of the group formed by $H_2$, $D_2$ and HD. The properties of the plasma discharge are influenced by using such gas mixtures.

It is known that the addition of relatively small quantities of the above-mentioned gases to helium does not only influence the ignition and sustain voltage of the plasma discharge, but such added gases generally also influence the afterglow decay time of the plasma discharge.

Upon mounting the display panel, the channel plate is connected to an exhaust installation by means of which the display panel is vacuum-exhausted. Subsequently, the channels are filled with the ionizable gas mixture.

Since the quantity of additional gas in the gas mixture will not remain constant during the operation of the display panel due to loss of additional gas, the partial pressure of the additional gas in the gas mixture will not remain constant, which is undesirable. A material, referred to as getter, dispensing the additional gas is therefore provided. The material used as a getter is also referred to as guest material.

In practice, the getter is first secured in the exhaust tube or in the exhaust box before the display panel is vacuum-exhausted and filled with gas, whereafter the exhaust tube or exhaust box is fritted on the channel plate at approximately 450° C. The panel is connected to the exhaust installation via the exhaust tube and vacuum-exhausted. The display panel is filled with the ionizable gas mixture via the same way.

Figure 3A:
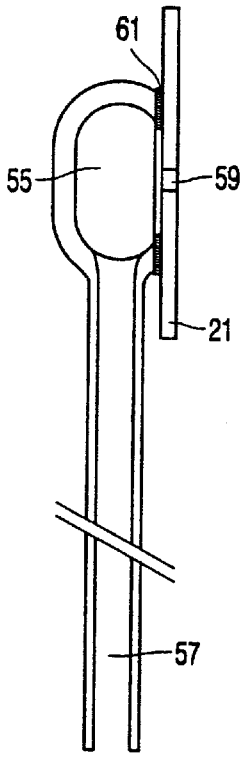
FIGS. 3(*a*) and 3(*b*) are a side elevational view and a plan view, respectively, of an exhaust tube with an exhaust box of a display panel according to the invention.
Figure 3B:
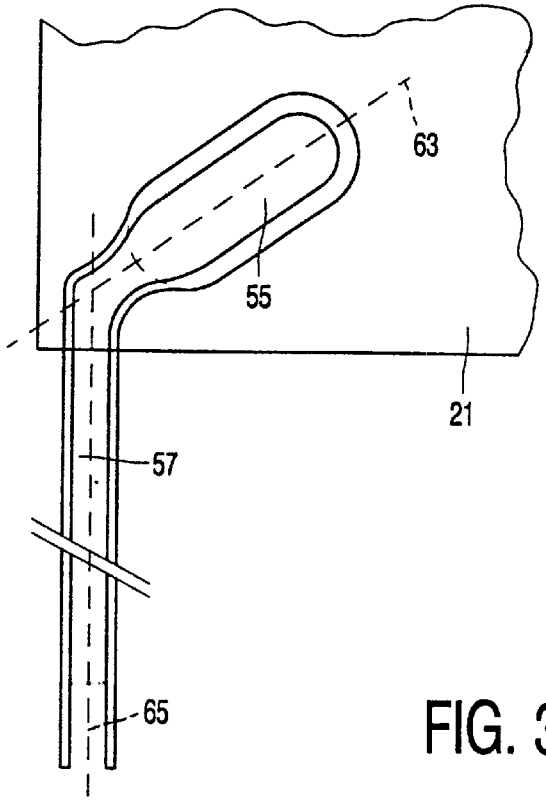
Figure 5:
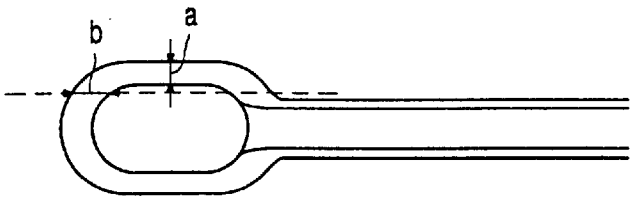
FIG. 5 illustrates the difference in thickness between the wall of exhaust box and the edge of the open portion.

The present invention proposes to provide the exhaust tube on the channel plate in a plane parallel to that of the channel plate. FIG. 3(*a*) shows the first substrate 21, in other words, the glass plate in which the channels are provided. An exhaust box 55 with an exhaust tube 57 is provided on the substrate 21. An aperture 59 via which the channels 31, 32, 33, 34, 35 can be vacuum-exhausted and subsequently filled with gas is present in the channel plate 21 at the side of the display panel remote from the display side. At the location of the aperture 59, the exhaust box 55 is fritted on the channel plate, with the frit seams 61 being the result. Both the exhaust box 55 and the channel plate 21 are formed from the same material, for example glass, so that the tension in the frit seam is reduced to a minimum. Since the exhaust tube is also made of glass, the exhaust tube 57 and the exhaust box 55 can be made in one assembly. In that case, the exhaust box 57 can be implemented, for example, as a widening of the exhaust tube which is sealed at the end facing away from the exhaust tube. At the location of this widening, the exhaust box is partly ground open. Consequently, the thickness of the edge thereby produced will be larger than the thickness of the wall of the exhaust box. From FIG. 5, it can be seen that the thickness b is larger than the thickness a. As a result, it is sufficient to use a relatively thin-walled and hence light-weight exhaust box, while a sufficiently rigid frit seam can still be realized. Due to this construction, it is also sufficient to use an exhaust tube of relatively thin glass, which is to the benefit of the weight of the display panel. In fact, the exhaust tube is considerably less vulnerable than in a position where it is provided, for example, substantially perpendicular to the channel plate.

FIG. 3(*b*) shows a preferred embodiment of the assembly of exhaust tube and exhaust box. The longitudinal axis 63 of the exhaust tube 57 and the longitudinal axis 65 of the exhaust box 57 enclose an angle of, for example 45°. In this way, the exhaust box 55 and the exhaust tube 57 remain outside the active part of the display panel and will thus not be visible at the display side.

The exhaust box 55 may be alternatively dispensed with. In that case, the exhaust tube 57 may be directly fritted onto the substrate 21. The exhaust tube may then consist of, for example, two parts mutually enclosing an angle of 45°.

Figure 4:
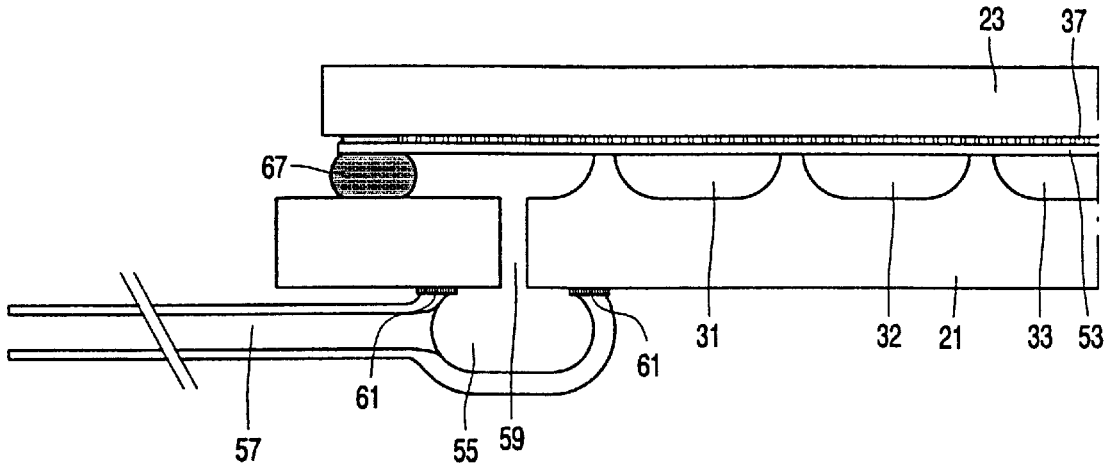
FIG. 4 shows diagrammatically a display panel according to the invention.

FIG. 4 shows diagrammatically an embodiment of a display panel according to the invention. Components corresponding to those in other Figures are denoted by the same reference numerals. FIG. 4 shows an embodiment of a display panel in which the exhaust box 55 and the exhaust tube 57 are made in one assembly. The exhaust box 55 is secured to the channel plate 21 by means of frit seams 61, at the location of the aperture 59 in the channel plate 21. The first substrate 21 and the second substrate 23 are secured to each other by means of a frit seam 67.

The present invention has been extensively described, by way of example, with reference to a PALC display, but is also applicable to plasma display panels.

What is claimed is:

1. A display panel comprising:

a display screen having a display screen surface;

a substrate having at least one compartment containing an ionizable gas mixture, electrodes being present in the at least one compartment for selectively ionizing the ionizable gas mixture during operation;

an exhaust tube made of the same material as the substrate and extending in a plane parallel to that of the display panel on a substrate surface located opposite the display screen surface; and an exhaust box made of the same material as the substrate and constituted by a widening of the exhaust tube, the exhaust box having least a part that is longitudinally ground open at the location of the widening, the longitudinal axis of the exhaust tube and the longitudinal axis of the exhaust box enclosing an angle between 30° and 60°, and the exhaust tube extending in a direction parallel to one side of the display panel.

* * * * *